United States Patent [19]

Schick et al.

[11] 4,073,736

[45] Feb. 14, 1978

[54] METAL WORKING COMPOSITIONS

[75] Inventors: John W. Schick, Cherry Hill; Robert H. Davis, Pitman, both of N.J.

[73] Assignee: Mobil Oil Corporation, New York, N.Y.

[21] Appl. No.: 734,215

[22] Filed: Oct. 20, 1976

Related U.S. Application Data

[63] Continuation-in-part of Ser. No. 559,103, March 17, 1975, abandoned.

[51] Int. Cl.[2] ..... C10M 3/06; C10M 1/38; C10M 3/32; C10M 5/28

[52] U.S. Cl. ..... 252/31; 72/42; 252/48.2; 252/48.6; 252/52 R

[58] Field of Search ..... 72/42; 252/31, 48.2, 252/48.6, 52 R

[56] References Cited

U.S. PATENT DOCUMENTS

| | | | |
|---|---|---|---|
| 2,620,304 | 12/1952 | Stewart et al. | 252/48.2 |
| 3,124,531 | 3/1964 | Whetzel et al. | 252/52 R |
| 3,130,159 | 4/1964 | Stedt | 252/31 |
| 3,919,093 | 11/1975 | Davis et al. | 252/31 |
| 3,933,658 | 1/1976 | Beiswanger et al. | 252/31 |

FOREIGN PATENT DOCUMENTS

| | | | |
|---|---|---|---|
| 721,210 | 1/1955 | United Kingdom | 252/48.2 |

*Primary Examiner*—Delbert E. Gantz
*Assistant Examiner*—Irving Vaughn
*Attorney, Agent, or Firm*—Charles A. Huggett; Thomas S. Szatkowski

[57] ABSTRACT

Compositions containing a base lubricant, an antiwear amount of a polypropylene glycol and sulfur; and a solubility improving amount of a monohydric alcohol having from 5 to 30 carbon atoms are provided. These compositions are especially useful for metal working and cutting applications.

13 Claims, No Drawings

METAL WORKING COMPOSITIONS

CROSS REFERENCE TO RELATED APPLICATIONS

This is a continuation-in-part of application Ser. No. 559,103, filed Mar. 17, 1975, now abandoned.

BACKGROUND OF THE INVENTION

1. Field of the Invention

This invention relates to lubricant compositions and, in one of its aspects, relates more particularly to lubricant compositions, such as lubricating oils and greases which normally exhibit wearing effects on machinery with which they may come into contact.

2. Description of the Prior Art

Prior to the present invention, polypropylene glycols have been employed as anti-wear agents in lubricant compositions, such as lubricating oils and greases, in a wide variety of automotive and metal working applications. Their utility, however, in lubricant compositions is restricted because of poor compatability with lubricants, such as solvent refined paraffinic oils. It is therefore highly desirable to enhance the solubility of these polypropylene glycols in the lubricant compositions employed for various industrial applications.

In U.S. Pat. No. 3,124,531, lubricants for use in rolling of aluminum sheets and foil are described. Lubricants used in such operations must be volatile enough to evaporate during the metal annealing process and leave no residue or stain. This patent teaches producing such lubricants from light mineral oils having a viscosity of from about 30 to about 60 SUS at 100° F. A fatty alcohol of the formula R—OH where R is a straight paraffinic chain of from 10 to 20 carbon atoms and polypropylene glycol are added to the light mineral oil to improve the lubricity,. This disclosure is distinguished from the compositions of the present invention in the viscosity of the lubricant employed. Additionally, sulfur, which is a necessary component of the compositions of the instant invention, must be excluded from the patentees composition due to its staining tendencies.

In U.S. Pat. No. 3,919,093, lubricant compositions which contain (1) an alkene oxide polymer, prepared by the reaction of from 1 to 30 moles of an alkylene oxide with from 70 to 99 moles of an alcohol, amine, amide, organic acid, phenol or mercaptan and (2) sulfur are disclosed.

Neither of these references disclose the novel composition of this invention.

SUMMARY OF THE INVENTION

It has now been found that the increased antiwear properties of mineral oil-based and synthetic oil-based lubricants, including lubricating oils and greases, employing polypropylene glycols and sulfur as antiwear agents, can be enhanced by introducing into the lubricant (containing the polypropylene glycol and sulfur), a solubility improving amount of a monohydric alcohol having the formula R—OH where R is an alkyl or alkenyl group of 5 to 30 carbon atoms.

The polypropylene glycols of the general formula:

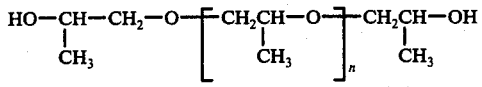

where $n$ may range from about 4 to about 170 and preferably ranges from about 15 to about 66, which are employed as an antiwear agent in the lubricant composition, may be of any desired molecular weight. Particularly preferred are polypropylene glycols having a molecular weight from about 400 to about 10,000 and still more preferred are polypropylene glycols having a molecular weight of from about 1000 to about 4000. The polypropylene glycol utilized in the compositions of this invention are also known to the art as poly(oxypropylene)glycols. However, the polypropylene glycol nomenclature is used herein.

The sulfur employed in the novel mixtures of the present invention may comprise elemental sulfur or a sulfur-containing material or sulfur compound. It may be combined with the lubricant before the polypropylene glycol and alcohol are added, as a sulfurized mineral oil, for example The term "sulfur" is intended to include elemental sulfur as well as organic sulfur compounds. Insofar as elemental sulfur is concerned, this is intended to include sulfur powders having any of the allotropic forms and flowers of sulfur. In addition, alkyl sulfides may be employed including dialkyl and disulfides, unsymmetrical alkyl sulfides, disulfides and polysulfides in which the alkyl groups have carbon atoms ranging from 1 to 20. Sulfurized fats may also be employed. There may also be employed aromatic sulfides including phenyl sulfides and substituted-aryl polysulfides. Particularly preferred of the aromatic sulfides is dibenzyl disulfide. These sulfides may contain up to about 10 atoms of sulfur per mole of sulfide. Also included in the sulfur compounds, that may be employed in the synergistic mixtures of the present invention, are those described in U.S. Pat. No. 2,993,858.

The alcohol employed as a solubility improver is preferably a straight-chain or branched-chain alkyl or alkenyl alcohol having from 5 to 30 carbon atoms. In this respect, it is essential that the alcohol does not contain less than 5 carbon atoms, since, in such instances, instability of the lubricant composition with concommitant phase separation occurs. If the alcohol contains more than 30 carbon atoms solubility improvement becomes lost.

The polypropylene glycol and the alcohol may be employed in the lubricant in any desired proportions. For many applications, the polypropylene glycol and the alcohol may be employed in a weight ratio of 1 to 0.1–10 and particularly in a weight ratio of 1:1. The sulfur can be employed in an amount of from about 0.01 to about 80% by weight, preferably about 0.05 to about 40% by weight of the polypropylene glycol. In many applications the mixture of the polypropylene glycol sulfur and alcohol are employed in the base lubricant in an amount from about 0.2 to about 20% by weight. Particularly preferred are mixtures of the polypropylene glycol, sulfur and alcohol which are present in the base lubricant in an amount from about 1 to about 6% by weight.

The lubricant composition, in general, comprises a mineral oil or synthetic oil-based lubricant, containing the aforementioned mixtures of polypropylene glycol sulfur and alcohol. With regard to the lubricant composition, employed in the form of a mineral oil, particularly preferred are oils having lubricating viscosities from about 100 SSU at 100° F to about 2,000 SSU at 100° F. The viscosity should be about 100 SSU at 100° F or greater in order to provide compositions which are effective for metal working and cutting operations. In still more preferred applications, the mineral oil may have a lubricating viscosity from about 55 SSU at 210° F to about 250 SSU at 210° F. Of particular significance is the improvement of petroleum distillate lubricating oils having boiling points as high as 650° F or above and also mixtures of such oils. It should be noted, in this respect, that the term "distillate oils" is not intended to be restricted to straight-run distillate fractions. These distillate oils can be straight-run distillate oils, catalytically or thermally cracked (including hydrocracked) distillate oils, or mixtures of straight-run distillate oils, naphthas and the like, with cracked distillate stocks and may be of varying viscosities and pour points. Moreover, such oils can be treated in accordance with well-known commercial methods, such as acid or caustic treatment, hydrogenation, solvent-refining, clay treatment and the like.

The aforementioned mixtures of polypropylene glycol, sulfur and alcohol may also be incorporated, for their antiwear effect, in grease compositions. Such greases may comprise the combination of a wide variety of lubricating vehicles and thickening or gelling agents. Thus, greases in which the aforementioned glycols, sulfur and alcohols are particularly effective may comprise any of the conventional hydrocarbon oils of lubricating viscosity, as the oil vehicle, and may include mineral oils or mineral oils in combination with synthetic lubricating oils, aliphatic phosphates, esters and di-esters, silicates, siloxanes and oxalkyl ethers and esters. Mineral lubricating oils, preferably employed as the lubricating vehicle, may be of any suitable lubricating viscosity range from about 100 SSU at 100° F to about 6,000 SSU at 100° F, and preferably, from about 55 to about 250 SSU at 210° F. These oils may have viscosity indexes from about 50 to a about 130 but preferably have indexes from about 70 to about 95. The average molecular weights of these oils may range from about 250 to about 800. The lubricating oil is employed in the grease composition in an amount sufficient to constitute the balance of the total grease composition, after accounting for the desired quantity of the thickening agent, and other additive components to be included in the grease formulation.

As previously indicated, the oil vehicles employed in the grease formulations of the present invention may comprise mineral oils, synthetic oils, or combinations of mineral oils with synthetic oils of lubricating viscosity. When high temperature stability is not a requirement of the finished grease, mineral oils having a viscosity of at least 100 SSU at 100° F, and particularly those falling within the range from about 100 SSU to about 6,000 SSU at 100° F may be employed. In instances, where synthetic vehicles are employed in addition to mineral oils, as the lubricating vehicle, various compounds of this type may be successfully utilized. Typical synthetic vehicles include: polypropylene, trimethylol propane esters, neopentyl and pentaerythritol esters, di-(2-ethyl hexyl) adipate, di-butyl phthalete, fluorocarbons, silicate esters, silanes, esters of phosphorous-containing acids, liquid ureas, ferrocene derivatives, hydrogenated mineral oils, chain-type polyphenyls, siloxanes and silicones (poly-siloxanes), alkyl-substituted diphenyl ethers typified by a butyl-substituted bis (p-phenoxy phenyl) ether, phenoxy phenyl ethers, etc.

The lubricating vehicles of the aforementioned improved greases of the present invention containing the above-described mixtures of polypropylene glycol sulfur and alcohol as additives, are combined with a grease-forming quantity of a thickening agent. For this purpose, a wide variety of materials may be employed. These thickening or gelling agents may include any of the conventional metal salts or soaps, which are dispersed in the lubricating vehicle in grease-forming quantities, in such degree as to impart to the resulting grease composition, the desired consistency. Other thickening agents that may be employed in the grease formation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any materials which are normally employed for thickening or gelling hydrocarbon fluids for forming greases can be used in preparation of the aforementioned improved greases in accordance with the present invention.

DESCRIPTION OF SPECIFIC EMBODIMENTS

In order to demonstrate the improvement in metal-cutting activity by employing the above-described polypropylene glycol, sulfur and alcohol mixtures in lubricant compositions, compared with that realized by employing the lubricant separately, i.e., in the absence of the aforementioned additive mixtures, comparative data were obtained as shown in the examples of the following Table I.

The data were obtained by means of a Tapping Efficiency Test and, in general, the procedure of this test involves measurement of torque developed in an internal threading operation employing SAE 1020 hot-rolled steel. In this test, thirty torque values are obtained with the test fluid and compared with thirty reference fluid values to obtain % Tapping Efficiency, i.e., $$\% \text{ Tapping Efficiency} = \frac{\text{Av. 30 Reference Fluid Torque Values} \times 100}{\text{Av. 30 Test Fluid Torque Values}}$$

The reference fluid employed in the aforementioned test comprised, by weight, 94% sulfurized mineral oil, 3% corrosive sulfurized fat and 3% oxidized $Ca/P_2S_5$ cutting fluid additive.

In general, the ability of a cutting oil to operate efficiently is measured by the tapping test. In the tapping test a series of holes is drilled in a test metal such as SAE 1020 hot-rolled steel. The holes are tapped in a drill press equipped with a table which is free to rotate about the center on ball-bearings. A torque arm is attached to this "floating table" and the arm in turn activates a spring scale, so that the actual torque during the tapping, with the oil being evaluated, is measured directly. The same conditions used in evaluating the test oil are employed in tapping with a strong oil which has arbitrarily been assigned an efficiency of 100%. The average torque in the test oil is compared to that of the standard and a relative efficiency is calculated on a percentage basis. For example,

| | |
|---|---|
| Torque with standard reference oil | 19.3 |
| Torque with test oil | 19.8 |
| Relative efficiency of test oil 19.3/19.8 × 100 | 97.4 |

This test described by C. D. Flemming and L. H. Sudholz in Lubrication Engineering, volume 12, No. 3, May-June 1956, pages 199 to 203, and also in U.S. Pat. No. 3,278,432.

It should be noted, in accordance with the foregoing Tapping Efficiency Test that if the test fluid torque values exceed the reference value, Tapping Efficiency is below 100%. Criteria for product acceptance are evaluated as follows:

| Tapping Efficiency | Comments |
|---|---|
| >100% | Fluid considered outstanding and should outperform reference product in severe cutting operations. |
| 80–100% | Acceptable range for moderate duty cutting fluids. |
| <80% | All products with Tapping Efficiencies below 80% are considered unacceptable. Torque values are erratic, frequently due to tap sticking and/or breakage. |

Employing the foregoing parameters, the following data in Table I were obtained with respect to the treated and untreated lubricant oil.

With respect to the data presented in Table I, Example 1 shows the unexpectedly high tapping efficiency obtained by using a composition in accordance with the present invention. Example 3 demonstrates the criticality of employing sulfur in the novel mixture of this invention.

As will be seen from the comparative data of Table II, polypropylene glycol, sulfur and alcohol mixtures provide clear, stable, metal working lubricans. Polypropylene glycol, sulfur and oil blends, on the other hand, in the absence of the alcohol, are unstable and considered unsatisfactory.

The comparative stability data involving the metal working fluids containing alcohol solubilized polyalkylene glycol and sulfur mixtures are shown in the following Table II.

In all cases three parts of solubilizing agent was combined with three parts polyalkylene glycol and 94 parts sulfurized mineral oil, which contained 0.68 weight % sulfur, by agitation at 170° F. After 24 hours' storage at 70° F, it was apparent that all alcohols containing 5 or more carbon atoms were excellent polypropylene glycol dispersants, i.e., the oil was clear and no separation was noted. Precipitation, however, was found to occur when attempts were made to solubilize polyethylene glycol or when oil-soluble alcohols containing less than 5 carbon atoms were employed.

TABLE I

TAPPING TEST
SOLUBILIZED POLYPROPYLENE GLYCOL

| Additive | Example 1 (wt. %) | Example 2 (wt. %) | Example 3 (wt. %) |
|---|---|---|---|
| Polypropylene glycol (2000 molec. wt.) | 3 | — | 3 |
| Oleyl alcohol | 3 | — | 3 |
| Sulfurized 150 SUS at 100° F Solvent Refined Paraffinic Oil (.68 wt. % sulfur) | 94 | 100 | — |
| 100 SUS at 100° F Solvent Refined Paraffinic Oil (non-sulfurized) | — | — | 94 |
| Tapping Efficiency % | 119 | 87 | 78 |

TABLE II

LUBRICANT COMPOSITIONS CONTAINING
SOLUBILIZED POLYPROPYLENE GLYCOL

| Example No. | Polyethylene Glycol 400 M.W. % Wt. | Polypropylene Glycol 400 M.W. % Wt. | Polypropylene Glycol 2000 M.W. % Wt. | Isopropyl Alcohol % Wt. |
|---|---|---|---|---|
| 1 | 3 | — | — | — |
| 2 | — | 3 | — | — |
| 3 | — | — | 3 | — |
| 4 | 3 | — | — | — |
| 5 | — | 3 | — | — |
| 6 | — | — | 3 | — |
| 7 | — | — | 3 | 3 |
| 8 | — | — | 3 | — |
| 9 | — | — | 3 | — |
| 10 | — | — | 3 | — |

| Example No. | N-Butyl Alcohol % Wt. | Octyl Alcohol % Wt. | Isohexadecyl Alcohol % Wt. | Oleyl Alcohol % Wt. |
|---|---|---|---|---|
| 1 | — | — | — | — |
| 2 | — | — | — | — |
| 3 | — | — | — | — |
| 4 | — | — | — | 3 |
| 5 | — | — | — | 3 |
| 6 | — | — | — | 3 |
| 7 | | — | — | — |
| 8 | 3 | — | — | — |
| 9 | — | 3 | — | — |
| 10 | — | — | 3 | — |

TABLE II-continued

| LUBRICANT COMPOSITIONS CONTAINING SOLUBILIZED POLYPROPYLENE GLYCOL | | |
|---|---|---|
| Example No. | Sulfurized (.68 wt. % Sulfur) 150 SUS at 100° F. Paraffinic Oil % Wt. | Lubricant Stability Test 24 Hrs. at 70° F. |
| 1 | 97 | Haze + Precipitate |
| 2 | 97 | Haze + Precipitate |
| 3 | 97 | Haze + Precipitate |
| 4 | 94 | Haze + Precipitate |
| 5 | 94 | Clear, No Separation |
| 6 | 94 | Clear, No Separation |
| 7 | 94 | Haze + Precipitate |
| 8 | 94 | Haze + Precipitate |
| 9 | 94 | Clear, No Separation |
| 10 | 94 | Clear, No Separation |

From the foregoing Table II it will be noted, as set forth in Examples 1, 2 and 3, that glycols prepared from propylene and/or ethylene oxie are not readily soluble in solvent-refined sulfurized paraffinic oil. Example 4 illustrates that alcohols are not suitable dispersants for ethylene oxide polymers. Examples 5 and 6 disclose that alcohols can be used to solubilize polypropylene glycols of varying molecular weight. Examples 7–10 indicated that alcohols containing 5 or more carbon atoms can be used to solubilize polypropylene glycols. The use of low molecular weight oil soluble alcohols results in undesirable phase separation.

While this invention has been described with reference to preferred compositions and components therefore, it will be understood by those skilled in the art that departure from the preferred embodiments can be effectively made and are within the scope of the specification.

We claim:

1. A metalworking composition which comprises: (1) a base lubricant selected from the group consisting of mineral oils, synthetic oils and greases thereof; (2) an antiwear amount of a polypropylene glycol and sulfur; (3) a solubility improving amount of a monohydric alcohol of the formula R—OH where R is an alkyl or alkenyl group of from 5 to 30 carbon atoms.

2. The composition of claim 1 wherein the polypropylene glycol has a molecular weight from about 400 to about 10,000.

3. The composition of claim 1 wherein the polypropylene glycol has a molecular weight from about 1000 to about 4000.

4. The composition of claim 1 wherein said alcohol is a straight-chain alcohol.

5. The composition of claim 1 wherein said alcohol is a branched-chain alcohol.

6. The composition of claim 1 wherein the polypropylene glycol and the alcohol are present in a weight ratio of 1.0 to 0.1–10.

7. The composition of claim 1 wherein the polypropylene glycol and alcohol are present in a weight ratio of 1:1.

8. The composition of claim 1 wherein the mixture of the polypropylene glycol, sulfur and alcohol is present in the base lubricant in an amount from about 0.2 to about 20% by weight.

9. The composition of claim 1 wherein the mixture of the polypropylene glycol, sulfur and alcohol is present in the base lubricant in an amount from about 1 to about 6% by weight.

10. The composition of claim 1 wherein the mineral oil has a lubricating viscosity from about 100 SSU at 100° F to about 2000 at 100° F.

11. The composition of claim 1 wherein the mineral oil has a lubricating viscosity from about 55 SSU at 210° F to about 250 SSU at 210° F.

12. The composition of claim 1 wherein said sulfur is employed in an amount from about 0.01 to about 80% by weight, of the polypropylene glycol.

13. The composition of claim 1 wherein said sulfur is employed in an amount from about 0.05 to about 40% by weight, of the polypropylene glycol.

* * * * *